United States Patent [19]

Farcasiu et al.

[11] Patent Number: 5,061,363

[45] Date of Patent: Oct. 29, 1991

[54] METHOD FOR CO-PROCESSING WASTE RUBBER AND CARBONACEOUS MATERIAL

[75] Inventors: Malvina Farcasiu; Charlene M. Smith, both of Pittsburgh, Pa.

[73] Assignee: The United States of America as represented by the United States Department of Energy, Washington, D.C.

[21] Appl. No.: 594,486

[22] Filed: Oct. 9, 1990

[51] Int. Cl.[5] ..... C10G 1/00

[52] U.S. Cl. ..... 208/419; 208/142; 208/145; 208/39; 208/420; 208/423; 208/435; 208/421; 208/404; 585/17; 585/241; 44/620

[58] Field of Search ..... 208/419, 420, 423, 435, 208/39, 142, 145; 585/241, 17; 44/620

[56] References Cited

U.S. PATENT DOCUMENTS

| | | | |
|---|---|---|---|
| 4,089,773 | 5/1978 | Espenschad | 208/428 |
| 4,117,886 | 10/1978 | Honaker | 208/428 |
| 4,251,364 | 2/1981 | Carr et al. | 208/428 |
| 4,255,258 | 3/1981 | Carr et al. | 208/428 |
| 4,518,478 | 4/1985 | Weller | 208/435 |
| 4,874,506 | 10/1989 | MacArthur et al. . | |

OTHER PUBLICATIONS

Derbyshire, "Catalysis in Coal Liquefaction: New Directions for Research", IEACR/08, Jun. 1988.

Van Nostrand's Scientific Encyclopedia, Seventh Edition, 1989, p. 505.

Farcasiu and Smith, "Modeling Coal Liquefaction: Decomposition of 4-(1-Naphthylmethyl)Bibenzyl Catalyzed by Carbon Black".

*Primary Examiner*—Helane E. Myers

*Attorney, Agent, or Firm*—Hugh W. Glenn; Robert J. Fisher; William R. Moser

[57] ABSTRACT

In a process for the co-processing of waste rubber and carbonaceous material to form a useful liquid product, the rubber and the carbonaceous material are combined and heated to the depolymerization temperature of the rubber in the presence of a source of hydrogen. The depolymerized rubber acts as a liquefying solvent for the carbonaceous material while a beneficial catalytic effect is obtained from the carbon black released on depolymerization the reinforced rubber. The reaction is carried out at liquefaction conditions of 380°-600° C. and 70-280 atmospheres hydrogen pressure. The resulting liquid is separated from residual solids and further processed such as by distillation or solvent extraction to provide a carbonaceous liquid useful for fuels and other purposes.

18 Claims, No Drawings

METHOD FOR CO-PROCESSING WASTE RUBBER AND CARBONACEOUS MATERIAL

CONTRACTUAL ORIGIN OF THE INVENTION

The U.S Government has rights in this invention pursuant to the employee/employer relationship of one of the inventors to the U.S. Department of Energy at the Pittsburgh Energy Technology Center.

BACKGROUND OF THE INVENTION

The present invention relates to a method for the co-processing of waste rubber and carbonaceous material. More particularly, it relates to an improved method for liquefying waste rubber in mixture with a carbonaceous material such as coal to permit use of depolymerized rubber as a hydrogen donor solvent and carbon black reinforcing pigment as a liquefaction catalyst.

In the United States, worn and used rubber products are creating an increasingly large disposal problem. During the past few years, it is estimated that about 200 million used tires are discarded each year. Each tire contains about 15 pounds (7 kilograms) of organic materials and 2 kilograms of carbon black. If the rubber in these tires could be reprocessed with coal at about a 1-to-1 weight ratio, approximately 40,000 barrels per day of transportation fuels could be produced. In addition to the used tires, there is also a substantial amount of other waste rubber products that could be reprocessed. At the present time, most of these tires and rubber products are serving no useful purpose but are occupying significant space in waste dumps, vacant lots, and other vacant facilities.

Coal liquefaction is typically achieved by heating the coal in the presence of a hydrogen donor solvent often with an added liquefaction catalyst. The most common solvent used are fractions derived from the liquified coal or heavy fractions from the petroleum industry in a co-processing operation. The liquefaction of coal is dependent on its hydrogenation which can be a function of the hydrogen donor solvent or the ability of the catalysts to promote reaction with hydrogen gas. Representative single and two-stage coal liquefaction processes are described generally in U.S. Pat. No. 4,874,506, and other issued U.S. Patents cited therein.

Typically, particulate coal feed is slurried in a coal-derived recycle solvent and the resulting slurry is preheated to near the reaction temperature and fed with hydrogen into a catalytic reactor. The reactor operates at relatively high temperature and pressure conditions to hydroconvert and liquefy a major portion of the coal and thereby produce hydrocarbon gas and liquid fractions.

Unfortunately, a large fraction of the coal liquefaction product is a residual oil containing preasphaltenes and asphaltene compounds having a low hydrogen content. It is these heavy, hydrogen-lean fractions that are often recycled for slurrying with the incoming coal to place an additional burden on the hydrogenation reactor.

SUMMARY OF THE INVENTION

Therefore in view of the above, it is an object of the present invention to provide a method for co-processing waste rubber with carbonaceous material.

It is also an object of the invention to provide a method for converting waste rubber into useful carbonaceous liquids and fuels.

It is a further object of the invention to provide a method for using the carbon black content of reinforced rubber tires as a liquefaction catalyst.

It is likewise an object of the invention to provide a source of liquefaction solvent for slurrying carbonaceous material in a hydrogenation process.

In accordance with the present invention, a method is provided for the liquefaction of carbonaceous material by forming a solid dry mixture of rubber with the carbonaceous material and heating the mixture to the depolymerization temperature of the rubber in the presence of hydrogen to form a liquid hydrocarbon and residual solid material. The liquid hydrocarbon is then separated as product from the residual solid material.

In other aspects of the invention, the dry mixture includes a finely divided carbon embedded as a reinforcing agent in the particulate rubber of the solid mixture. The carbon, present as carbon black, is released on the depolymerization of the rubber into contact with the carbonaceous material at a temperature in the range of 380°-600° C. and under a hydrogen pressure of 70-280 atmospheres. It is contemplated that the waste rubber can be natural rubber, synthetic rubber, or plastics having rubber-like properties while the carbonaceous material typically is coal. In some processes, it can be advantageous to add an additional liquefaction catalyst in form of a transition metal compound.

In more specific aspects of the invention, the rubber comprises a polymerized material selected from cis-polyisoprene, cis-polybutadiene, cis-polyisoprene, polymerized ethylene-propylene, polymerized styrene-butadiene, butyl rubber mixtures thereof.

This invention also contemplates a method for co-processing waste rubber and carbonaceous material to form a useful liquid product. The method includes combining the rubber with carbonaceous fuel and heating the mixture to the depolymerization temperature of the rubber in the presence of a source of hydrogen to form a hydrogen-rich liquid having constituents from both the rubber and the carbonaceous fuel.

In more specific aspects of the method, a vulcanized rubber with reinforcing carbon black is combined in mixture with the carbonaceous fuel and the resulting hydrogen-rich liquid is further processed to remove residual solids and separate the carbonaceous liquid into fractions by distillation. Selected distillation fractions are removed as product and optionally a portion of the liquified product recycled into mixture with the rubber and carbonaceous fuel. The mixture is heated to a temperature of 390°-440° C. at a hydrogen gas pressure of 70-280 atmospheres to form a hydrogen-rich liquid with residual solids.

DETAILED DESCRIPTION OF THE INVENTION

In one manner of carrying out the present invention, a carbonaceous material such as coal in combination with rubber or rubber-like material is heated to a temperature in excess of the depolymerization temperature of the rubber or rubber-like material in the presence of hydrogen gas under pressure to liquify both the rubber and the carbonaceous material.

Typically, a waste rubber material is co-processed with the carbonaceous material. Natural rubber, synthetic rubber and certain plastics having rubber-like properties are contemplated for use. Unless otherwise indicated the term "rubber" as used in this application is intended to include natural rubber, synthetic rubber and other rubber-like materials.

Waste rubber, particularly that used in vehicle tires, is ordinarily a vulcanized rubber including carbon black as a reinforcing agent for strength. The inventors have found the carbon black to have an advantageous catalytic effect in the cleavage of methylene and ethylene bridges between condensed polyaromatic rings. Such chemical functionalities are abundent in coal and other fossil fuels.

Preferably, the liquefaction reaction is performed at temperature of 380°-600° C. and at a hydrogen pressure of 70-280 atmospheres. In order to operate at more moderate temperatures and thereby reduced materials problems, a reaction temperature of 390°-440° C. at hydrogen pressures of 70-280 atmospheres are used.

Although the depolymerization of the rubber will provide a liquid solvent for liquefying a solid carbonaceous material such as coal, a selected fraction of the liquefaction product can be recycled into mixture with the coal and rubber during the hydrogenation step. This added recycle can be a convenient means of returning heavy liquid products for further processing and hydrogenation.

In addition to the carbon black within the waste rubber, other well-known coal liquefaction or hydrogenation catalysts could be added. Should the waste rubber being processed not include carbon black, finely divided carbon black can be added as a catalyst for liquefying the carbonaceous material.

As will be seen below, waste rubber materials on depolymerization provide an advantageous liquefaction and hydrogenation solvent. The waste rubber includes a higher percentage of hydrogen than an ordinary coal liquid and therefore reduces the hydrogen requirement from other sources.

Following the co-processing of the rubber and carbonaceous material, the hydrogen-rich liquid is further processed to remove residual solids and to separate the liquid into fractions by distillation and/or liquid extraction. As in prior liquefaction and hydrogenation processes, selected liquid fractions can be withdrawn as product or recycled to the hydrogenation step for further processing.

The following examples are submitted merely by way of illustration and are not intended to limit the present invention beyond the scope defined in the accompanying claims:

EXAMPLE I

Comparative Example 6.6 grams of a used rubber tire with an estimated organic content of 4.6 grams were heated in a laboratory shaker bomb under hydrogen pressure. The shaker bomb is a sealed vessel capable of containing elevated pressures while affording agitation of the contents. The reaction conditions were: 60 min, 425° C., 1000 psi $H_2$ at room temperature (approximately 2200 psi at the reaction temperature). The results were as follows:

- 2.25 grams methylene chloride insoluble (mostly including inorganic and carbon black);
- 0.03 grams methylene chloride soluble but heptane insoluble; and
- 4.32 grams heptane soluble material.

The heptane soluble fraction is of significant interest in the preparation of liquid fuels and has the following elemental analysis: 86.5%C; 10.9%H; and 0.4%S.

EXAMPLE II 6.6 grams of a used rubber tire were combined with 3.3 grams of Illinois #6 coal having an ash content of approximately 10%. These materials were treated under the same conditions as described in Example I.

The results were as follows:

- 3.83 grams methylene chloride insoluble material including;
  - 2 25 grams from the tire, 0.3 grams of coal ash, and 1.28 grams of unreacted coal;
- 0.57 grams of methylene chloride soluble material that was heptane insoluble; and
- 5.5 grams of heptane soluble material with 4.32 grams from the tire and 1.18 grams from coal.

The elemental analysis of the heptane soluble fraction was as follows:

| Run No. | % C | % H | % S |
|---|---|---|---|
| 1 | 84.8 | 10.5 | 0.5 |
| 2 | 83.2 | 10.3 | 0.5 |

EXAMPLE III

Comparative Example 3.3 grams of Illinois #6 coal and 6.6 grams of tetralin were treated under the same conditions as described in Example I. The analysis of the liquefaction products was as follows:

- 1.6 grams of methylene chloride insoluble material;
- 0.8 grams of methylene chloride soluble but heptane insoluble material; and
- 0.9 grams of heptane soluble material from the coal.

EXAMPLE IV

Comparative Example 6.6 grams of a tread compound were treated in the same manner as described in Example I. The tread compound was cross-link material from which tires can be made including 35% styrene-butadiene rubber, 8.5% cis-polybutadiene rubber, 33% carbon black, 20% aromatic oil, 1% zinc oxide and 1% sulfur. The product included 2.14 grams of methylene chloride insoluble material and 4.44 grams of heptane soluble material. This provided an overall conversion of organic materials to liquids of 100%. The elemental analysis of the heptane soluble fraction was 88.9% carbon, 10.1% hydrogen, 0.25% nitrogen, 0.13% sulfur and 1.2% oxygen.

EXAMPLE V 3.3 grams of tread compound (see Example IV) combined with 3.3 grams of Illinois #6 coal were treated under the same experimental conditions as described above. The product included the following:

- 2.9 grams of methylene chloride insoluble material with 1.07 grams from the tread compound, 1.53 grams of unreacted coal and 0.3 grams of coal ash;
- 0.41 grams of heptane insoluble from the coal; and
- 3.29 grams heptane soluble material including 2.22 grams from the tread compound and 1.07 grams from the coal.

The overall conversion of organic to liquid was 71%. The elemental analysis of the heptane soluble fraction was 7.8% carbon 9.7% hydrogen, 0.36% nitrogen, 0.47% sulfur and 1.71% oxygen.

EXAMPLE VI 2.16 grams of uncross-linked material (prepared by mixing the components described in Example IV without carbon black), 1.09 grams of carbon black (Cabot Corp., Mogul-L) and 3.3 grams of Illinois #6 coal were treated under the same conditions as described in the above Examples. The product resulting from this non-vulcanized material included:

2.72 grams of methylene chloride insoluble material;
0.61 grams of heptane insoluble material;
3.17 grams of heptane soluble material; and
0.05 grams of gas.

The overall conversion of organic to liquids was 69%. The elemental analysis of the heptane soluble fraction was: 87.5%C; 9.54%H, 0.56%N; 0.47%S; 1.97%O.

EXAMPLE VII

Comparative Example

The conditions of Example VI were employed except the carbon black was omitted and 2.17 grams of uncross-linked material was used. The results were as follows:

2 grams of methylene chloride insoluble;
0.4 grams of heptane insoluble;
2.7 grams of heptane soluble material; and
0.3 grams of gas.

The overall conversion of organic to liquid was 56%. The elemental analysis of the heptane soluble fraction was: 87.5% C; 9.39% H; 0.36% N; 0.57% S, 2.21% O.

It can be seen from the above Examples that waste rubber material can be conveniently liquefied and co-processed with carbonaceous material such as coal to form a hydrogen-rich product. The liquefied rubber product includes a higher hydrogen content than a typical coal hydrogenation product. In addition, finely divided carbon black, whether introduced as reinforcing agent in waste rubber material or added separately as a catalyst, increases the product of valuable heptane soluble material.

Although the present invention is described in terms of specific materials and process steps, it would be clear to one skilled in the art that various changes and modifications may be made in accordance with the invention as described in the accompanying claims. Such variations may include coprocessing of rubber materials with various fossil fuels or fractions thereof including not only coal and other solid carbonaceous materials but also heavy petroleum and other liquid carbonaceous fractions.

We claim:

1. A method for co-processing carbonaceous material and rubber comprising:

forming a mixture of the rubber and the carbonaceous material;

heating the mixture to the depolymerization temperature of the rubber in the presence of a source of hydrogen to form a hydrogenated liquid hydrocarbon and residual solids; and separating the liquid hydrocarbon from the residual solids.

2. The method of claim 1 wherein the mixture is heated to a temperature in the range of 380° to 600° C. at a hydrogen pressure of 70 to 280 atmospheres.

3. The method of claim 1 wherein the mixture contains a liquefaction catalyst including finely divided carbon.

4. The method of claim 3 wherein the finely divided carbon comprises carbon black embedded as reinforcing pigment in particulate rubber and wherein the carbon black is released on depolymerization of the rubber into contact with the carbonaceous material.

5. The method of claim 1 wherein the carbonaceous material is coal and the rubber is selected from the group of materials consisting of natural rubber, synthetic rubber, plastics having rubber-like properties and mixtures thereof.

6. The method of claim 5 wherein the rubber comprises a polymerized material selected form the group consisting of cis-polyisoprene, cis-polybutadiene, cis-polyisoprene, polymerized ethylene-propylene, polymerized styrene-butadiene, butyl rubber and mixtures thereof.

7. The method of claim 1 wherein the heating step is conducted in the presence of a coal liquefaction catalyst including a catalytically active, transition metal compound.

8. The method of claim 1 wherein particulate rubber obtained from used vehicle tires containing vulcanized polymeric material and embedded carbon black is included in the mixture.

9. The method of claim 8 wherein the heating at pressure is conducted at sufficient levels and for a sufficient time to liquefy at least a portion of the rubber and release the carbon black into contact with the formed liquid.

10. A method for the co-processing of waste rubber and carbonaceous material to form a useful liquid product comprising;

combining the rubber in mixture with the carbonaceous fuel;

Heating the mixture to the depolymerization temperature of the rubber in the presence of a source of hydrogen to form a hydrogen-rich liquid having constituents from both the rubber and the carbonaceous fuel.

11. The method of claim 10 wherein a vulcanized rubber with reinforcing pigment including carbon black is combined in mixture with the carbonaceous fuel;

12. The method of claim 10 wherein the hydrogen rich liquid is further processed to remove residual solids and to separate liquid fractions by distillation.

13. The method of claim 12 wherein selected distillation fractions are removed as product and at least a portion of other liquid fractions recycled into mixture with the rubber and the carbonaceous fuel.

14. The method of claim 10 wherein the mixture is heated to a temperature of 390° to 440° C. at a hydrogen gas pressure of 70 to 280 atmospheres to form a hydrogen-rich liquid and residual solids.

15. The method of claim 14 wherein the hydrogen-rich liquid includes at least 10% by weight hydrogen.

16. A method of claim 1 where the carbonaceous material is coal.

17. A method of claim 1 where the carbonaceous material is a heavy petroleum fraction.

18. The method according to claim 1 wherein a solid mixture of rubber and carbonaceous material are formed and at least a portion of the solid carbonaceous material is liquefied on heating and depolymerizing the rubber.

* * * * *